US009031470B2

(12) United States Patent
Kahatabi et al.

(10) Patent No.: US 9,031,470 B2
(45) Date of Patent: May 12, 2015

(54) LEP PRINTER, A PHOTO IMAGING PLATE FOR SUCH PRINTER AND A METHOD FOR WIPING SUCH PHOTO IMAGING PLATE

(75) Inventors: Rafael Kahatabi, Petah-Tiqwa (IL); Assaf Paldor, Jerusalem (IL); Giries Kadis, Jaffa (IL); Nurit Carmel-Barnea, Kiryat-Ono (IL); Sharon Nagler, Gan Yavna (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 229 days.

(21) Appl. No.: 13/491,037

(22) Filed: Jun. 7, 2012

(65) Prior Publication Data

US 2013/0327236 A1 Dec. 12, 2013

(51) Int. Cl.

| | |
|---|---|
| ***G03G 15/10*** | (2006.01) |
| ***G03G 21/00*** | (2006.01) |
| ***B41L 9/02*** | (2006.01) |

(52) U.S. Cl.

CPC ..... *B41L 9/02* (2013.01)

(58) Field of Classification Search

USPC ..... 399/249, 348, 343, 347, 350, 245

See application file for complete search history.

(56) References Cited

U.S. PATENT DOCUMENTS

| | | | | |
|---|---|---|---|---|
| 6,144,832 | A * | 11/2000 | Nimura et al. | 399/328 |
| 2004/0197689 | A1* | 10/2004 | Landa et al. | 430/67 |
| 2008/0019735 | A1* | 1/2008 | Ogaki et al. | 399/159 |
| 2008/0107455 | A1* | 5/2008 | Suzuki et al. | 399/286 |
| 2009/0148189 | A1* | 6/2009 | Fukazawa | 399/238 |
| 2011/0243603 | A1* | 10/2011 | Saito et al. | 399/111 |

FOREIGN PATENT DOCUMENTS

| | | |
|---|---|---|
| WO | WO-03019296 | 3/2003 |

* cited by examiner

*Primary Examiner* — Billy Lactaoen

(57) ABSTRACT

In an LEP printer having a wiper blade for wiping a photo imaging plate, the photo imaging plate may include a PIP foil with a trailing edge having a zone of a roughening pattern which includes notches that are inclined with respect to a contact line of the wiper blade. The zone of roughening pattern is confined between two opposite margins lacking any roughening.

19 Claims, 4 Drawing Sheets

LEP PRINTER, A PHOTO IMAGING PLATE FOR SUCH PRINTER AND A METHOD FOR WIPING SUCH PHOTO IMAGING PLATE

BACKGROUND

Liquid electro-photographic (LEP) printing involves digital printing using electro-ink, which includes small color particles suspended in imaging oil that can be attracted or repelled to a photoconductive sheet (photo imaging plate) by causing a voltage differential on that sheet.

The first stage of LEP digital printing in such LEP printers involves selective charging of the surface of the Photo Imaging Plate (PIP) using its photo-induced electric conductivity and a laser beam. Next, charged liquid ink is applied to the surface of the PIP. Due to the selective charging ink is attracted to image pixels (at locations on the PIP where surface potential was affected by a laser beam), and rejected from background pixels (where the laser has not discharged the surface potential). This latent image is then transferred from the surface of the PIP to an intermediate transfer media (ITM, also known as "blanket") in what is known as the "first transfer". The image is then transferred in what is known as "second transfer" from the ITM to the paper by pressing the paper to the ITM by an impressing drum. In order to evaporate solvents present in the ink liquid prior to the encounter with the paper, the surface of the ITM is maintained very hot, and since the ITM and the PIP are firmly pressed against each other during the first transfer, the PIP foil absorbs heat which is to be dissipated before the next printing cycle. Moreover, since the efficiency of the first transfer is not 100%, some ink and imaging oil residues may remain on the surface of the PIP foil, and these residues may therefore inadvertently affect the next printing cycle if not attended to.

BRIEF DESCRIPTION OF THE DRAWINGS

Examples are described in the following detailed description and illustrated in the accompanying drawings in which.

DETAILED DESCRIPTION

In the following detailed description, numerous specific details are set forth. However, it will be understood by those skilled in the art that examples may be practiced without these specific details. In other instances, well-known methods, procedures, and components have not been described in detail so as not to obscure the discussed examples.

Although examples are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method examples described herein are not constrained to a particular order or sequence. Additionally, some of the described method examples or elements thereof can occur or be performed at the same point in time.

Liquid electro-photographic (LEP) printing, sometimes referred to as liquid electrostatic printing, uses liquid toner to form images on paper or other print media. LEP printing is often used for large scale commercial printing. Basic LEP printing process involves placing a uniform electrostatic charge on a photoconductor, the photoconductive surface on a rotating drum for example, and exposing the photoconductor to light in the pattern of the desired printed image to discharge the areas of the photoconductor exposed to the light. The resulting latent electrostatic image on the photoconductor is developed by applying a thin layer of liquid toner to the photoconductor. Liquid toner generally consists of charged toner particles dispersed in a carrier liquid. The charged toner particles adhere to the discharged areas on the photoconductor (discharged area development—DAD) or to the charged areas (charged area development—CAD), depending on the charge of the toner particles, to form the desired toner image on the photoconductor. The toner image is transferred from the photoconductor to an intermediate transfer member and then from the intermediate transfer member to the paper or other print medium.

In some LEP printers, the photoconductive element includes a replaceable film of photoconductive material wrapped around a rotating drum. This drum is commonly referred to as the PIP (Photo Imaging Plate) and the thin film of conductive material as the PIP foil. The PIP foil is replaced periodically, once or twice a work shift for example depending on the printing volume, to maintain the good print quality. A new PIP foil is accurately aligned to the PIP drum during installation to help ensure good print quality and to minimize the risk of damaging the PIP foil during installation and printing.

Figure 1:
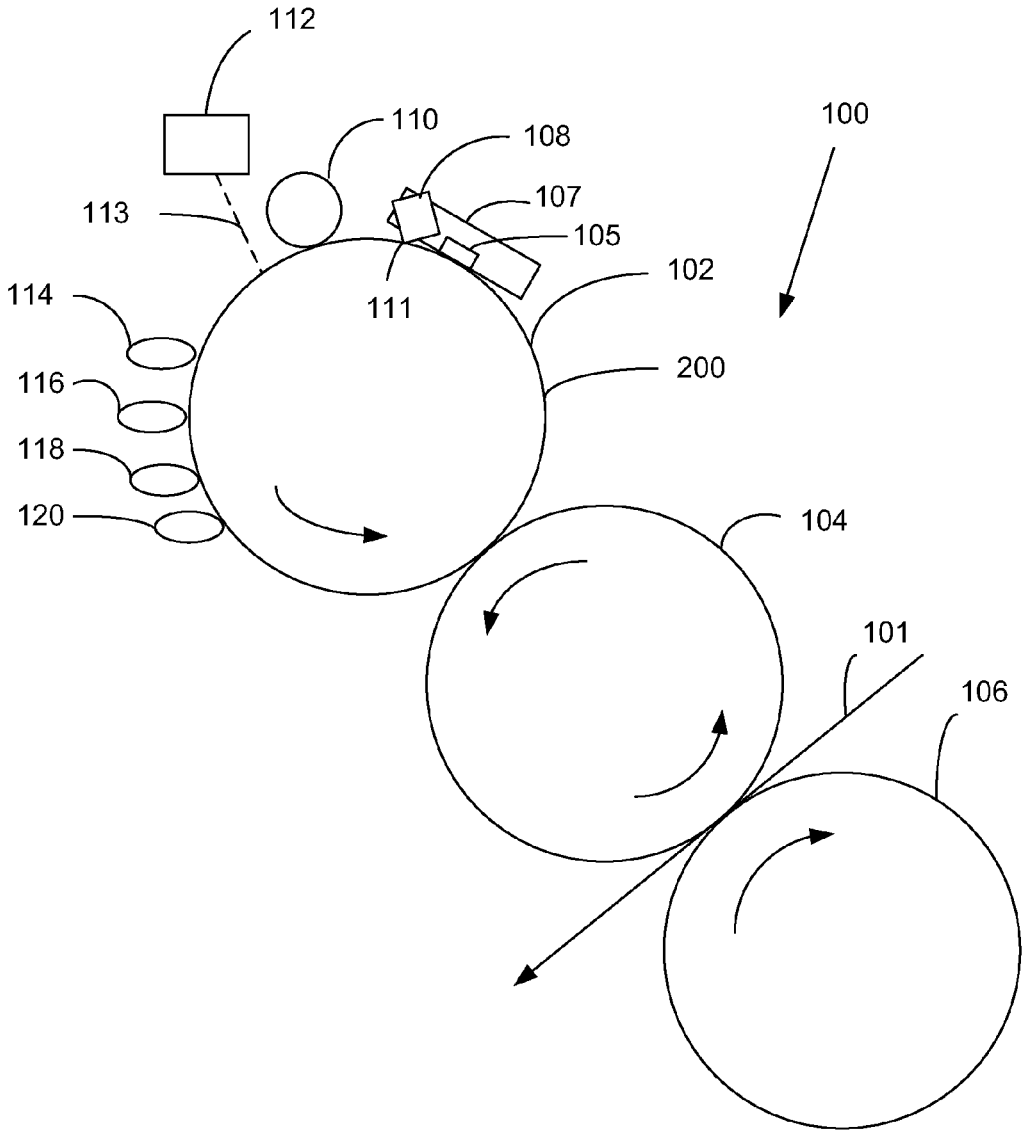
FIG. 1 schematically illustrates main parts of a printing press according to an example.

FIG. 1 schematically illustrates main parts of an LED printer 100 according to an example. Printer 100 may include three drums (the drums in this drawing are not presented to scale): PIP drum 102, ITM 104 and impression drum 106. PIP foil 200, in accordance with an example, is wrapped around PIP drum 102. Magenta 114, yellow 116, cyan 118 and black 120 developers are arranged in series adjacent PIP drum 102. Charge roller 110 is designed to roll over PIP foil 200 and charge it with electrostatic charges. Writing head 112 is designed to irradiate PIP foil 200 with a laser beam 113, in a predetermined pattern forming an image which is to be printed. Areas on the PIP foil 200 which are irradiated by the laser beam 113 from writing head 112 are discharged while other areas on the PIP foil remain charged. Charged ink from the color developers (Magenta 114, yellow 116, cyan 118 and black 120—each in turn) is then applied on the PIP foil, being attracted to the laser irradiated areas while being repelled from other areas of the PIP foil 200. In another example, and with oppositely charged ink, ink would be repelled from areas of the PIP foil that were irradiated by the laser and attracted to other areas of the PIP foil. The formed image is then transferred in the "first transfer" to the blanket (ITM 104) and from there, in the "second transfer", to the paper 101 (or other printable medium) which is passed between and impressed by ITM 104 and impression drum 106.

A designated cleaning station 107 may be provided, which is designed to apply a coolant (e.g. cooling oil) from a coolant orifice 105 to cool the heated PIP drum 102 and foil 200. Cleaning station 107 may further include wiper blade 108 (e.g., a rubber bar) to wipe dust and dirt particles which remain on the PIP foil 200 after the image has been transferred to the blanket (ITM 104), and the PIP drum 102 has completed a rotation, and to maintain a thin layer of imaging oil on the surface of the PIP foil 200. Additionally, a sponge roller (not shown in this figure) may be used.

Wiper blade 108 may be firmly pressed against PIP foil 200 (e.g. employing a force of about 50 N/m), defining a contact line 111 across the PIP foil 200, where the wiper blade 108 maintains effective contact with PIP foil, to ensure a smooth thin layer of imaging oil on the surface of the PIP foil 200 for high printing quality during the next printing cycle.

However, dust and dirt particles may be trapped at the tip of the wiper blade 108. As a result a significantly thicker layer of imaging oil may thus be applied on the corresponding place on the PIP foil 200, which might locally damage the functionality of the PIP foil. Due to the continuous rotation of PIP drum 102, the inferior localized wiping ability of wiper blade 108 may evolve into a sharp brutal scratch throughout the vertical axis of the actual print.

Even in the best case scenario, in which the operator notices this in real time and stops the printer to manually clean the wiper blade, there is a significant impact on both the customer's experience (TCE) and the press utilization aspects. Unfortunately, it is not rare for operators to not act immediately in real time (e.g. due to a non-sensitive job). In such cases, excessive quantities of imaging oil may form "rings" on the charge roller 110 and even on the developer roller of the binary ink developer (BID, e.g. 114, 116, 118, 129), which are harder to spot and the replacement of which can be costly. Additionally, if the trapped particle is not removed within a few cycles it may eventually induce irreversible damage to the surface of the PIP foil 200, e.g. in the form of a mechanical scratch or a localized change in chemical characteristics.

Thus a "passive" particle removal mechanism is introduced, according to an example, to relieve particles trapped at the tip of the wiper blade 108 without any intervention by the operator. It was suggested in the past to roughen the Mylar (PET) layer on the trailing edge of the PIP foil so as to assist in relieving trapped particles, however if notches are made throughout the entire width of the PIP foil, the foil may tear upon impact with the wiper blade.

Figure 2:
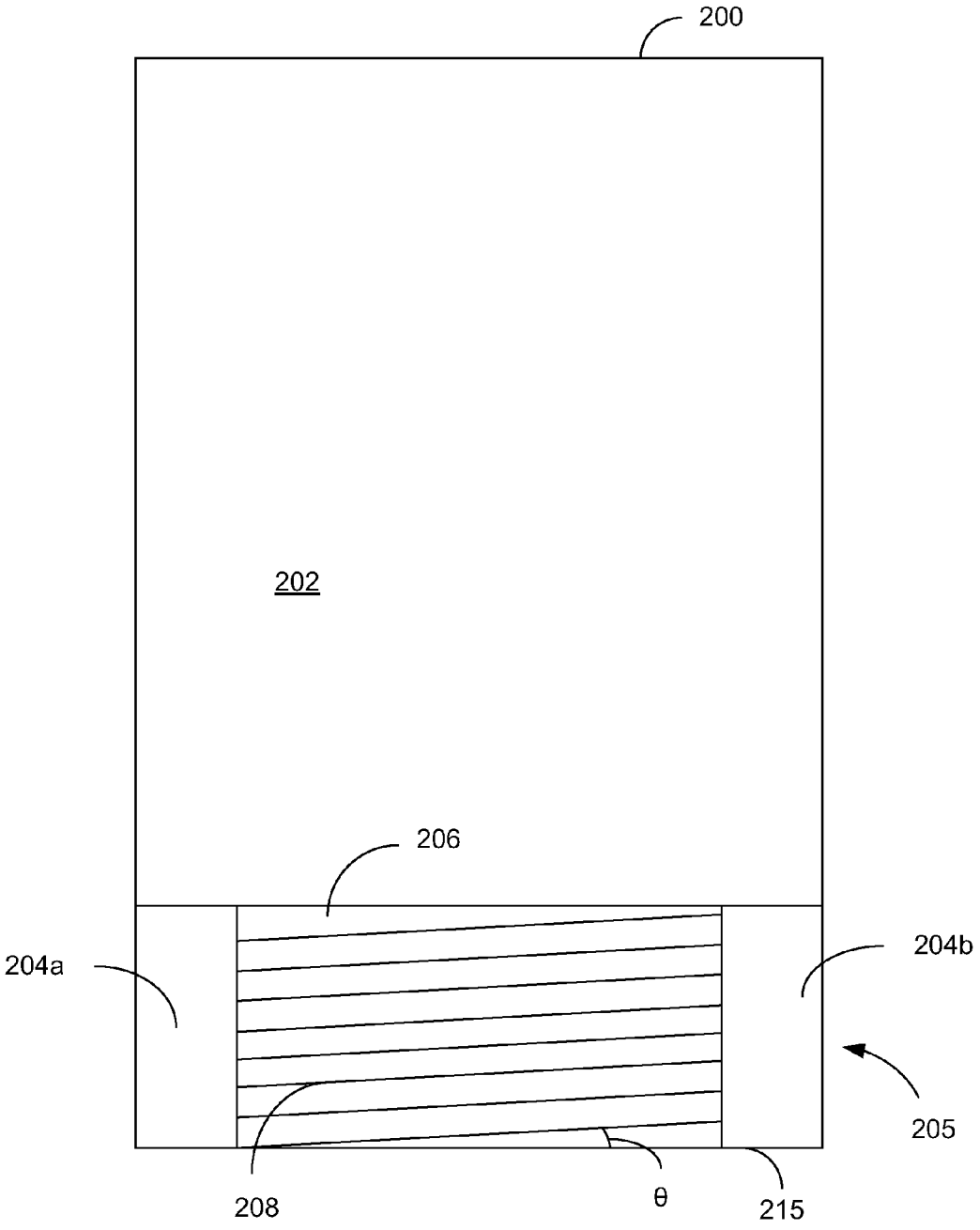
FIG. 2 illustrates a PIP foil, according to an example.

FIG. 2 illustrates a PIP foil 200, according to an example. PIP foil 200 includes a main printing area 202 (e.g. the organic photo conductor—OPC—the functional layers of the PIP) on which the latent image is to be formed. A trailing edge 205 of PIP foil 200, which is the edge of the PIP foil 200 which follows the main printing area 202 in the direction of rotation of the PIP drum 102, includes a zone of roughening pattern 206, confined between two substantially opposite lateral margins 204*a*, 204*b*. The zone of roughening pattern 206 includes a roughening pattern 208, which, for example, as shown in this figure, may include a plurality of notches arranged in a substantially parallel arrangement.

The notches of the roughening pattern 208 do not stretch across the entire width of the trailing edge 205 of the PIP foil 200, leaving the lateral margins 204*a*, 204*b*, of the PIP foil 200 intact to act as enforcements to prevent inadvertent tearing of the trailing edge 205 of the PIP foil 200.

If the lateral margins 204*a*, 204*b* are too wide, some portions of the wiper blade 108 may not encounter the notches. According to some examples the width of the lateral margins 204*a*, 204*b*, are designed such that the wiper blade extends substantially across the zone of roughening pattern 206, to preserve the mechanical integrity of the PIP foil 200.

Further, if the notches of the roughening pattern 208 are provided substantially parallel to the horizontal edge 215 of the PIP foil 200, the impact of the wiper blade 108 may induce undesired stretching of the entire PIP foil 200. Consequently, the segment of the PIP foil which is under the laser beam at that instance may slightly shift, causing the laser beam to impinge on the wrong place of the PIP foil 200, leaving a thin missing strip on print. The length of the arc over the PIP drum 102 between the wiper blade 108 and the writing head 112 determines the location of that missing strip on print. To prevent such inadvertent stretching the notches of the roughening pattern 208 are designed to be slightly inclined with respect to the horizontal edge 215 of the PIP foil 200, reducing the abruptness of the impact between the wiper blade and the PIP foil 200 to prevent stretching. According to some examples, the notches of the roughening pattern 208 are inclined with respect to the horizontal edge 215 in an angle θ that, in some examples, is greater than 0 and smaller than 10 degrees (e.g. $0<\theta<10$), and in some examples angle θ ranges between 2 to 6 degrees (e.g. $2<\theta<6$). In a more specific example, angle θ is about 5 degrees.

The PIP foil 200 may be installed such that the trailing edge is adhesively attached to the underlying preceding revolution (close to the leading edge of the foil), thanks to an intermediate wetting layer of imaging oil.

Detachment of the trailing edge—a failure mode also known as PIP buckle—may result in dangerous contact between the wiggling trailing edge and the various PIP satellites, and at the very least requires replacement of the PIP. It is clear that the notching process induced extraneous strains exerted on the Mylar layer of the PIP foil. The inventors have found that if the notches of the roughening pattern are kept shallow enough so that at least some of the underlying layer of the Mylar is left intact (e.g. 40-50 micrometers), then the likelihood of PIP buckling may be significantly reduced (practically to about the same level of likelihood of PIP buckling in non-notched PIP foils).

According to some examples, the zone of roughening pattern is heated (e.g. to a temperature of about 70 to 80 degrees, and in some examples to a temperature of about 75 degrees Celsius, during the notching process. The inventors have found that if the zone of roughening pattern in the trailing edge of a PIP foil is subjected to such heating during the notching process, then the chances of that PIP foil to buckle on the LEP printer are substantially decreased. This may perhaps be attributed to increased ductility of the PIP foil matter, thus enabling quenching the extraneous strains the foil experiences during notching.

The inventors have conducted several experiments in which one half of a trailing edge of a PIP foil was left smooth, whereas a roughening pattern of notches was embedded on the other half. Some manipulation was used to generate excessive sludge and fused ink on the wiper blade of the cleaning station. There was a significant difference in the number of scratches on print between the two halves of the PIP foil (significantly less scratches on the side of the print corresponding to the half of the PIP foil that included the roughening pattern), attesting efficient removal of particles from the tip of the wiper blade in the roughening pattern zone. Specifically it was found that the percentage of pages being rejected due to wiper induced scratches was reduced from 14.5% (historic reference) to 2.9%—a 5-fold reduction.

Correspondingly, the average lifespan of a PIP foil may thus increase by some 30%. The frequency of wiper-related interventions by operators (cleaning/flipping or replacing the wiper) may also decrease significantly.

Figure 3A:
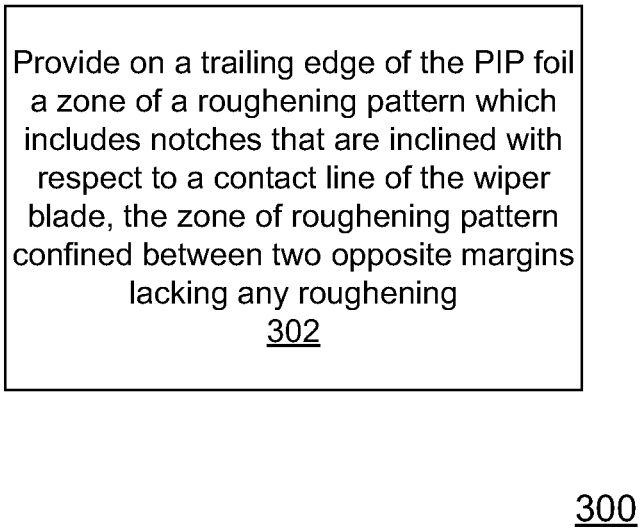
FIG. 3A illustrates a method for enhancing wiping a PIP foil of a photo imaging plate of an LEP printer, according to an example.

According to an example, a roughening pattern may include 4-7, and in a more specific example 5, substantially parallel notches which are spaced some 2 mm from each other. In some examples, each of the notches is 15-50 micrometers wide and 15-30 micrometers deep. In a specific example, each of the notches is about 20 micrometers wide and about 20 micrometers deep Accordingly, a method 300 for enhancing wiping a PIP foil of a photo imaging plate of an LEP printer, according to an example, is illustrated in FIG. 3A. Method 300 may include providing on a trailing edge of the PIP foil a zone of a roughening pattern which includes notches that are inclined with respect to a contact line of the wiper blade, the zone of roughening pattern confined between two opposite margins lacking any roughening.

Figure 3B:
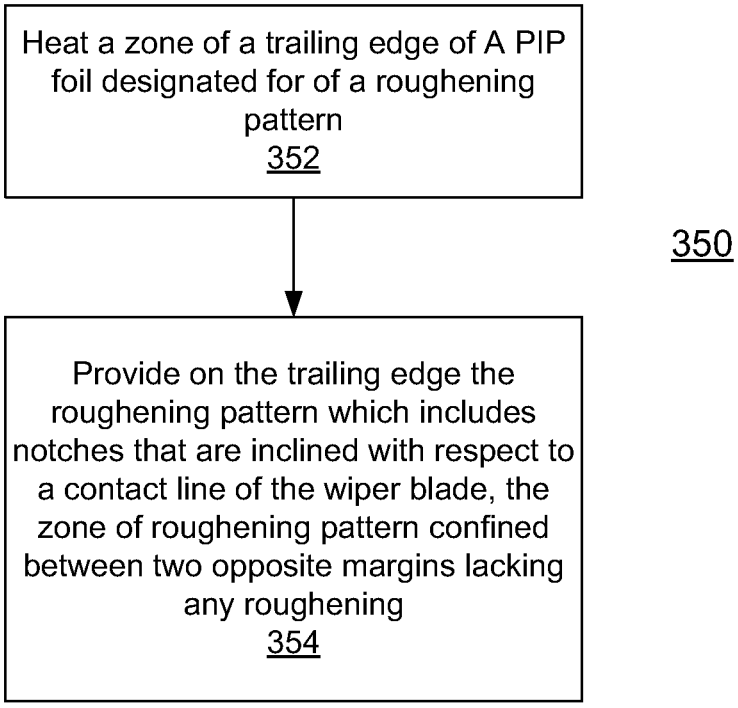
FIG. 3B illustrates a method for enhancing wiping a PIP foil of a photo imaging plate of an LEP printer, according to an example.

FIG. 3B illustrates a method 350 for enhancing wiping a PIP foil of a photo imaging plate of an LEP printer, according to an example. Method 350 may include heating 352 the zone of roughening pattern of the trailing edge of the PIP foil in a process for providing the roughening pattern on the trailing edge. Method 350 may also include providing 354 the roughening pattern on the trailing edge.

What is claimed is:

1. A method comprising:

providing a wiper blade in a liquid electro-photographic (LEP) printer; and arranging a photo imaging plate that is to be wiped by the wiper blade in the LEP printer, the photo imaging plate comprising a photo imaging plate foil that includes a photoconductive material and a trailing edge portion having a zone of a roughening pattern which includes notches created by heating the zone to a specified temperature during a process in which the notches are being formed, each of the notches having a length that extends across a width of the photo imaging plate foil, where the length of each of the notches is inclined at an angle with respect to a contact line of the wiper blade, the angle greater than zero degrees and smaller than 10 degrees, and the zone of roughening pattern confined between two opposite margins lacking any roughening.

2. The method of claim 1, wherein the angle ranges between 2 to 6 degrees.

3. The method of claim 1, wherein the angle is about 5 degrees.

4. The method of claim 1, wherein the notches are substantially parallel to each other.

5. The method of claim 4, wherein the notches are spaced some 2 mm from each other.

6. The method of claim 1, wherein each of the notches is 15-50 micrometers wide and 15-30 micrometers deep.

7. The method of claim 6, wherein each of the notches is about 20 micrometers wide and about 20 micrometers deep.

8. The method of claim 1, further comprising:

providing a photo imaging plate drum on which the photo imaging plate foil is mounted; and providing a cleaning station including the wiper blade.

9. A method for forming a photo imaging plate foil of a photo imaging plate of a liquid electro-photographic (LEP) printer, the method comprising:

forming on a trailing edge portion of the photo imaging plate foil a zone of a roughening pattern which includes notches each having a length that extends across a width of the photo imaging plate foil that comprises a photoconductive material, where the length of each of the notches is inclined at an angle with respect to a contact line of a wiper blade, the angle greater than zero degrees and smaller than 10 degrees, and the zone of roughening pattern confined between two opposite margins lacking any roughening; and heating, to a specified temperature, the zone of roughening pattern in the photo imaging plate foil during a process in which the notches are being formed.

10. The method of claim 9, wherein the angle ranges between 2 to 6 degrees.

11. The method of claim 9, wherein the notches are substantially parallel to each other.

12. The method of claim 9, wherein the heating comprises heating the zone of roughening pattern to the specified temperature of 70 to 80 degrees Celsius.

13. The method of claim 12, wherein the specified temperature is about 75 degrees Celsius.

14. The method of claim 1, wherein arranging the photo imaging plate foil comprises arranging the photo imaging plate foil that includes:

a main printing area on which a latent image to be printed onto a print media is to be formed, the main printing area being without any roughening pattern, and a trailing edge that follows the main printing area in a direction of rotation of a drum carrying the photo imaging plate foil, and wherein the length of each of the notches is inclined at an angle greater than zero degrees and less than 10 degrees with respect to the trailing edge.

15. The method of claim 1, further comprising providing a head to irradiate the photo imaging plate foil with laser.

16. The method of claim 9, further comprising:

forming a main printing area in the photo imaging plate foil, wherein a latent image to be printed onto a print media is to be formed on the main printing area, the main printing area being without any roughening pattern, and forming a trailing edge in the photo imaging plate foil, the trailing edge following the main printing area in a direction of rotation of a drum carrying the photo imaging plate foil, and wherein the length of each of the notches is inclined at an angle greater than zero degrees and less than 10 degrees with respect to the trailing edge.

17. A photo imaging plate for use in a liquid electro-photographic (LEP) printer having a wiper blade, comprising:

a photo imaging plate foil including a photo conductor and a trailing edge portion having a zone of a roughening pattern which includes notches created by heating the zone to a specified temperature during forming of the notches, each of the notches having a length that extends across a width of the photo imaging plate foil, where the length of each of the notches is inclined at an angle with respect to a contact line of the wiper blade that is for contacting and wiping a surface of the photo imaging plate, the angle greater than zero degrees and smaller than 10 degrees, and the zone of roughening pattern is confined between two opposite margins lacking any roughening.

18. The method of claim 1, wherein the specified temperature is between 70 to 80 degrees Celsius.

19. The photo imaging plate of claim 17, wherein the specified temperature is between 70 to 80 degrees Celsius.

* * * * *

UNITED STATES PATENT AND TRADEMARK OFFICE

CERTIFICATE OF CORRECTION

PATENT NO. : 9,031,470 B2
APPLICATION NO. : 13/491037
DATED : May 12, 2015
INVENTOR(S) : Rafael Kahatabi et al.

It is certified that error appears in the above-identified patent and that said Letters Patent is hereby corrected as shown below:

Title page, item (75), Inventors, in column 1, line 5, delete "Gan Yavna" and insert -- Gan Yavne --, therefor.

Signed and Sealed this
Twenty-first Day of June, 2016

Michelle K. Lee

Michelle K. Lee
*Director of the United States Patent and Trademark Office*